US007151331B2

(12) United States Patent
Niayesh et al.

(10) Patent No.: US 7,151,331 B2
(45) Date of Patent: Dec. 19, 2006

(54) PROCESS AND DEVICE FOR CURRENT SWITCHING WITH A FLUID-DRIVEN LIQUID METAL CURRENT SWITCH

(75) Inventors: Kaveh Niayesh, Teheran (IR); Friedrich Koenig, Oberbözberg (CH); Andreas Dahlquist, Zürich (CH)

(73) Assignee: ABB Research Ltd, Zurich (CH)

( * ) Notice: Subject to any disclaimer, the term of this patent is extended or adjusted under 35 U.S.C. 154(b) by 0 days.

(21) Appl. No.: 11/328,160

(22) Filed: Jan. 10, 2006

(65) Prior Publication Data

US 2006/0146466 A1 Jul. 6, 2006

Related U.S. Application Data

(63) Continuation of application No. PCT/CH2004/000418, filed on Jul. 1, 2004.

(30) Foreign Application Priority Data

Jul. 10, 2003 (EP) ..... 3405520
Jul. 10, 2003 (EP) ..... 3405521

(51) Int. Cl.
*H01H 3/00* (2006.01)

(52) U.S. Cl. ..... 307/139

(58) Field of Classification Search ..... 307/139
See application file for complete search history.

(56) References Cited

U.S. PATENT DOCUMENTS 4,419,650 A 12/1983 John
6,870,111 B1 * 3/2005 Wong ..... 200/182

FOREIGN PATENT DOCUMENTS

| | | |
|---|---|---|
| DE | 312051 | 5/1919 |
| DE | 1 802 643 | 12/1959 |
| DE | 1 224 181 | 9/1966 |
| DE | 1 294 858 | 5/1969 |
| DE | 26 52 506 A1 | 5/1978 |
| DE | 40 12 385 A1 | 3/1991 |
| DE | 199 03 939 A1 | 8/2000 |
| DE | 100 48 430 A1 | 4/2002 |
| GB | 296 231 | 8/1928 |
| WO | 00/77811 A1 | 12/2000 |

OTHER PUBLICATIONS

International Search Report dated Oct. 8, 2004.
International Preliminary Search Report dated Oct. 19, 2005.
European Search Report dated Dec. 4, 2003.

* cited by examiner

*Primary Examiner*—Robert L. DeBeradinis
(74) *Attorney, Agent, or Firm*—Buchanan Ingersoll & Rooney PC

(57) ABSTRACT

A process and a device are disclosed for current limiting and/or circuit breaking and a switchgear assembly with such a device. As claimed in the invention a liquid metal is moved by a dielectric fluid drive with a control between a first current path for the rated current ($I_1$), a second current path for current limiting ($I_2$) and optionally a third current path for current interruption (i=0), the working fluid acting mechanically with a definable drive pressure ($p_1$, $p_2$) directly on one surface of the liquid metal. Embodiments are, among others, the following: insulating gas or insulating liquid as the drive fluid; pressure drive with pressure vessels and valves or a piezodrive for the working fluid; and design criteria for the liquid metal arrangement, drive pressure ($p_1$, $p_2$) and piezodrive. Advantages are, among others, the following: reversible current limiting and current interruption, also suited for high voltages and current, fast reaction times, low wear and maintenance-friendly.

19 Claims, 5 Drawing Sheets

PROCESS AND DEVICE FOR CURRENT SWITCHING WITH A FLUID-DRIVEN LIQUID METAL CURRENT SWITCH

RELATED APPLICATION

The present application is a continuation application which claims the benefit of the filing date of PCT/CH2004/000418 filed Jul. 1, 2004, under 35 U.S.C. §120, the priority of EP 03405520.2 and 03405521.0 filed Jul. 10, 2003, the disclosures of which are herby incorporated by reference in their entireties.

TECHNICAL DOMAIN

The invention relates to the area of primary engineering for electrical switchgear assemblies, especially current limiting and circuit breaking in high, medium or low voltage switchgear assemblies. It is based on a process and a device for current limiting or circuit breaking and a switchgear assembly with such a device as claimed in the preamble of the independent claims.

BACKGROUND

DE 26 52 506 discloses an electrical high current switch with liquid metal. On the one hand, a liquid metal mixture is used for wetting the solid metal electrodes and for reducing the contact resistance. Here the liquid metal is driven against the force of gravity by mechanical displacement, for example by movable contacts or pneumatically driven plunger pistons into the contact gap. The liquid metal can be additionally stabilized and fixed in the contact gap by the pinch effect according to which a current-carrying conductor undergoes radial striction by the current which is flowing through it. External magnetic fields and magnetic stray fluxes, for example by current feeds, can cause flow instabilities in the liquid metal and are shielded and are optionally allowed during disconnection in order to support extinguishing of the arc in the liquid metal.

The disadvantage is that gradual current limitation is not possible and arcs between the solid electrodes cause oxidation in the liquid metal. The design of the high current switch comprises seals for liquid metal, inert gas or a vacuum, and is accordingly complex.

DE 40 12 385 A1 discloses a current-controlled interrupting device with an operating principle which is based on the pinch effect with liquid metal. There is an individual, narrow, liquid metal-filled channel between the two solid metal electrodes. For an overcurrent the liquid conductor as a result of electromagnetic force is constricted by the pinch effect so that the current itself pinches and separates the liquid conductor. The displaced liquid metal is collected in a storage tank and after the overcurrent event flows back again. Contact separation takes place without an arc. But the device is only suited for relatively small currents, low voltages and slow interruption times, and therefore does not offer a lasting off state.

DE 199 03 939 A1 discloses a self-recovering current limiting means with liquid metal. There is a pressure-proof insulating housing between the two solid metal electrodes; in it there is liquid metal in the compressor spaces and in the connecting channels which lie in between and which connect the compressor spaces, so that there is a current path for nominal currents between the solid electrodes. In the connecting channels the current path is narrowed relative to the compressor spaces. The connecting channels are greatly heated during short circuit currents and evolve a gas. Avalanche-like gas bubble formation in the connecting channels vaporizes the liquid metal into the compressor spaces so that a current limiting arc is ignited in the connecting channels from which liquid metal has now been removed. After decay of the overcurrent the liquid metal can condense again and the current path is again ready for operation.

WO 00/77811 discloses a development of the self-recovering current limiting means. The connecting channels are conically widened to the top, so that the fill level of the liquid metal can be varied and the rated current carrying capacity can be changed over a wide range. Moreover, a meandering current path is formed by an offset arrangement of the connecting channels so that in overcurrent-induced vaporization of the liquid metal a series of current-limiting arcs is ignited. These pinch effect current limiters require a structure which is very stable with respect to pressure and temperature; this is structurally complex. Major wear within the current limiters occurs due to current limiting by arc and burn-off residues can contaminate the liquid metal. Recondensation of the liquid metal causes a conductive state immediately after a short circuit so that there is no off state.

This application refers to the prior art which is disclosed in utility model DE 1 802 643. It shows a call device for filling stations in which a bell switch is electrically closed by a liquid metal by a vehicle rolling over an air-filled hose and it's thus being compressed such that the escaping air moves the liquid metal column between the bell contacts. The liquid metal is moved purely passively by an external action, specifically by a vehicle which is to be detected. Since the liquid metal column which is captured in the hose acts as a vehicle detector, there is no self-contained control for specific opening and closing of the switch by means of the liquid metal.

SUMMARY

A process, a device and an electrical switchgear assembly with such a device are disclosed for improved and simplified current switching.

In a first aspect, a process is disclosed for current limiting and/or circuit breaking with a liquid metal current switch which comprises solid electrodes and a liquid metal tank with at least one channel for a liquid metal, in the first operating state between the solid electrodes an operating current being routed on a first current path through the current switch and the first current path being routed at least partially through the liquid metal which is in the first position, in a second operating state the liquid metal being moved by a dielectric fluid drive which is controlled by a control along one direction of motion into at least one second position, the working fluid being dielectric and acting mechanically directly with a definable drive pressure on one surface of the liquid metal, and the liquid metal in at least one second position being located at least partially, especially completely in series with the dielectric or the resistance material and in this way a current-limiting and/or current-interrupting second current path being formed by the current switch, for a given voltage level the maximum electrical resistance of the dielectric being dimensioned to a finite value according to the current which is to be limited or to a dielectric insulation value for interrupting the current. The working fluid is moved into direct physical contact with the liquid metal, and in the second operating state, when the liquid metal is displaced between the solid electrodes and thus the liquid metal contact is opened, bridges a dielectrically insulating distance between the solid electrodes. The fluid drive is especially suited for an arc-free current limiter, for circuit breakers with or without arc formation, and for current-limiting circuit breakers. The process can also be used at very high voltage levels. The current switching with a fluid-driven liquid metal takes place reversibly and is therefore maintenance-friendly and economical. The fluid drive is moreover characterized by high reliability and low wear.

In a first embodiment, the dielectric working fluid is a dielectric gas and or a dielectric liquid, and mixing of the fluid with the liquid metal is largely avoided. With a dielectric gas drive an especially high dielectric strength can be achieved. With a dielectric liquid drive an especially fast reaction time of the current switch can be implemented.

The embodiment as shown in FIG. 3 has the advantage that prompt reaction times of the current switch are achieved without mixing of the liquid metal with the working fluid. Moreover the flow state of the liquid metal in the aggregate liquid state remains very effectively under control.

An exemplary embodiment has the advantage that progressive current limitation can be accomplished with a gentle current limiting or interruption characteristic which is as free of arcs as possible.

An advantageous configuration is also disclosed for a fluid operated current-limiting switch or current limiter with an integrated switch.

An especially simple configuration of a fluid pressure drive with pressurized storage tanks for a gas or generally for a working fluid is also disclosed.

An exemplary piezo-liquid metal drive has the advantage of high reliability, low wear and efficient pressure transfer from the working fluid to the liquid metal. An especially fast reaction time of the current switch is implemented due to the incompressibility of the drive fluid.

Other exemplary embodiments relate to an especially simple configuration for the piezodrive with liquid metal, the dielectric strength in the contact-opened state being favorably influenced by the choice of the drive fluid, and dimensioning criteria for an advantageous mechanical layout of the piezo-fluid drive.

In another aspect, the invention relates to a liquid metal current switch for current limiting and/or circuit breaking, especially for executing the process, comprising solid electrodes and a liquid metal tank with at least one channel for a liquid metal, in a first operating state between the solid electrodes there being a first current path for an operating current through the current switch and the first current path being routed at least partially through the liquid metal which is in the first position, the dielectric fluid drive having a working fluid and a control, and being designed to move the liquid metal along one direction of motion into at least one second position, furthermore the working fluid being dielectric and acting mechanically directly on one surface of the liquid metal with a definable drive pressure, in the liquid metal tank there being a dielectric or a resistance material and in the second operating state the liquid metal in at least one second position being at least partially in series with the dielectric or the resistance means and in this way forming a current-limiting and/or current-interrupting second current path in the current switch, for a given voltage level the maximum electrical resistance of the dielectric being dimensioned to a dielectric insulating value for interrupting the current or to a finite value according to the current which is to be limited.

Components and dimensioning criteria are disclosed for optimum design of the fluid drive and especially the piezodrive.

Advantageous geometrical arrangements of liquid metal and resistance or insulator means are disclosed. In particular high voltages and high currents can also be efficiently and safely handled by a series connection of liquid metal columns in alternation with a dielectric.

BRIEF DESCRIPTION OF THE DRAWINGS

Other details, advantages and applications of the invention follow from the claims and from the specification and figures below.

The same parts are provided with the same reference numbers in the figures.

DETAILED DESCRIPTION

Figure 1A:
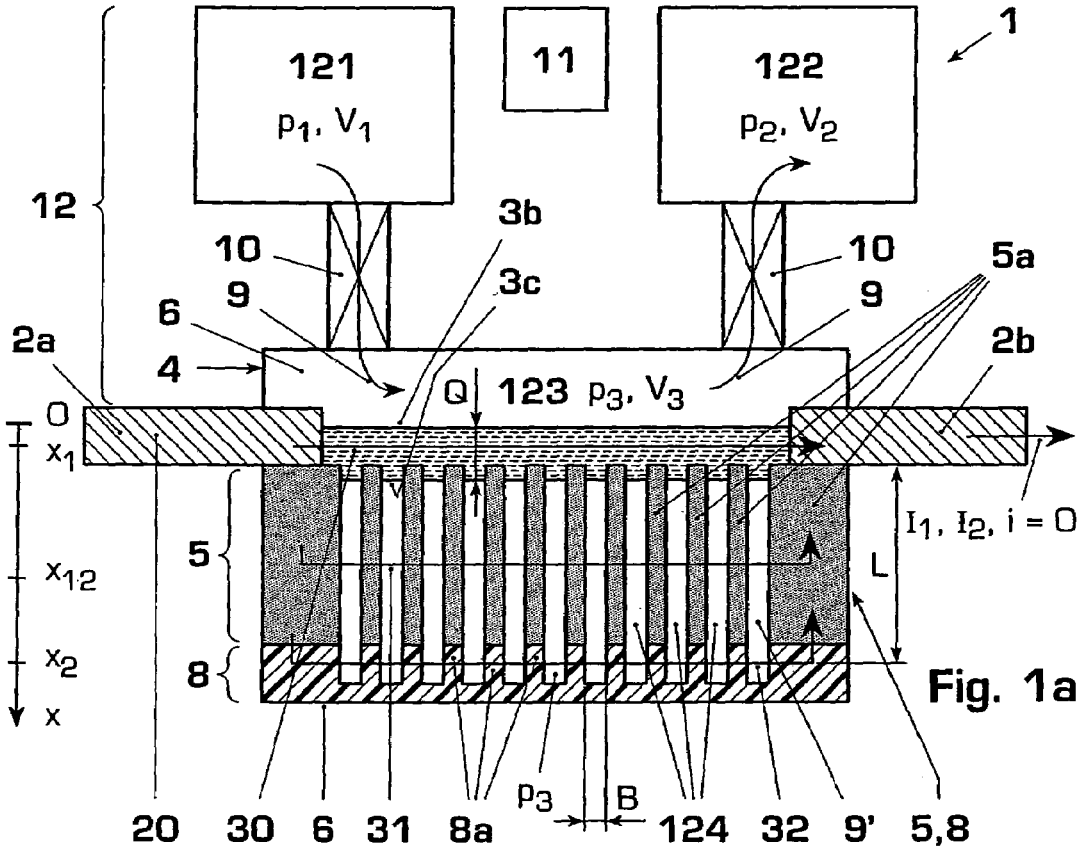
FIGS. 1*a*, 1*b* show one embodiment of the liquid metal current switch as claimed in the invention with a gas drive in a cross section and a plan view.
Figure 1B:
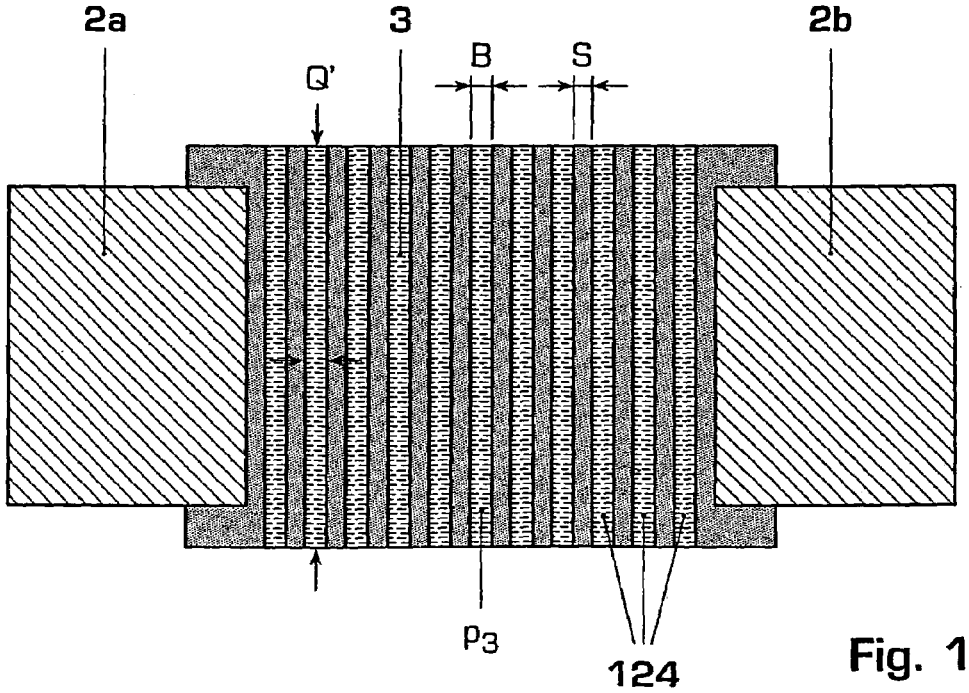

FIGS. 1*a*, 1*b* show in a cross section and a plan view one embodiment of a liquid metal current switch 1, especially a liquid metal current limiter 1 or liquid metal circuit breaker 1. The current switch 1 comprises solid metal electrodes 2*a*, 2*b* for connection of a current supply 20 and a tank 4 for the liquid metal 3. The tank 4 has a bottom 6 and cover 6 of insulating material between which there are a dielectric 5, 8, 9 and at least one channel 3*a* for the liquid metal 3.

As claimed in the invention, the current switch 1 has a dielectric fluid drive 12 with a control 11 in which a working fluid 9 with a definable drive pressure $p_1$, $p_2$ acts mechanically directly on the front surface 3*b* of the liquid metal 3 and moves the liquid metal columns 3 from a first position $x_1$ into a second position $x_{12}$, $x_2$. In the first position $x_1$, the liquid metal 3 is located at least partially in the first current path 30 for an operating current $I_1$. In the second position $x_{12}$, $x_2$ the liquid metal 3 is at least partially and preferably completely in series with the dielectric 5, 8, 9 so that a current-limiting and/or current-interrupting second current path 31, 32 is formed by the current switch 1.

In the embodiment as shown in FIGS. 1*a*, 1*b* the dielectric fluid drive 12 has first means 121–122 for producing a drive pressure $p_1$, $p_2$ in the fluid 9, second means 10, 4, 123, 124 for bringing the fluid 9 into contact with the liquid metal 3, and the control 12. In particular the first means 121–122 comprise an interruption pressure vessel 121 for contact opening of the liquid metal 3 and a connection pressure vessel 122 for contact closing of the liquid metal 3. In particular the second means 10, 4, 123, 124 comprise at least one valve 10 for filling a working pressure vessel 123 with a working fluid 9 under the desired operating pressure $p_1$, $p_2$ and for transferring the pressure from the working fluid 9 to the liquid metal 3. In operation of the pressure drive 12 the valves 10 and thus the pressure vessels 121–124 are activated by the control 11 such that the working pressure vessel 123 for the working fluid 9 for moving the liquid metal 3 is connected to the interruption pressure vessel 121 for contact opening of the liquid metal 3 and with the connection pressure vessel 122 for contact closing of the liquid metal 3.

The second means 10, 4, 123, 124 can also comprise a compression pressure vessel 124 with a captured compressible fluid 9' for applying a resetting force to the back surface 3*c* of the liquid metal 3. In doing so the compressible fluid 9' acts as a spring with the desired resetting force. Alternatively the resetting force can also be actively applied by a pressure vessel not shown analogously to 121 or 122 filled with a compressible or incompressible fluid 9'.

The dielectric working fluid 9 can be a dielectric gas 9 and/or a dielectric liquid. The working fluid 9 will essentially not be mixed with the liquid metal 3. Preferably the dielectric working fluid 9 is an insulating gas 9, especially dry air, nitrogen, sulfur hexafluoride, argon or a vacuum, and/or an insulator liquid, especially transformer oil or silicone oil. In addition, the liquid metal column 3 can be surrounded by a protective gas and a protective liquid (not shown here).

Advantageously the drive pressure $p_1$, $p_2$ is set according to the switching time of the current switch 1, especially according to the overcurrent $I_2$ which is to be limited, and to the path-time characteristic x(t) of the liquid metal 3 in the second current path 31 which is necessary for this purpose. Also the drive or fluid pressure $p_1$, $p_2$ should be lower than the surface tension of the surface 3*b* of the liquid metal 3 which has been exposed to the fluid pressure $p_1$, $p_2$. Preferably the liquid metal 3 is set into ordered flowing motion by the fluid drive 12. Thus the liquid metal 3 in the first and the second operating state remains in the liquid aggregate state. In this way high currents can be limited or interrupted even without the pinch effect with very fast reaction times of down to less than 1 ms.

For the pressure rating it furthermore applies: When the working volume $V_3$ is much smaller than the storage volumes $V_1$, $V_2$, ($V_3 << V_1$, $V_2$), the pressures in the storage tanks 121, 122 over time will only decrease imperceptibly. The drive pressure $p_3$ will then be equal to $p_3=p_1=p_{open\ contact}$ and for contact closing $p_3=p_2=p_{close\ contact}$. For the sake of simplification the drive pressure $p_1$ can also be chosen to be equal to the atmospheric pressure. It goes without saying that in practice a small pump is necessary to maintain at least one of the drive pressures $p_1$, $p_2$.

For advantageous dimensioning of the liquid metal current switch 1 the following rules apply: A cross sectional area Q of the liquid metal 3 in the first current path 30 should be dimensioned according to the current carrying capacity of the current switch 1; and/or the width S and number of segments 5*a*, 8*a* for separating the channels 3*a* for the liquid metal 3 and the type of working fluid 9 should be dimensioned according to the dielectric strength of the current switch 1 in a second operating state; and/or a cross section Q', especially the channel width B, and the surface composition of the channels 3*a* should also be dimensioned for the liquid metal 3 and the type of liquid metal 3 according to the required surface tension of the surface 3*b* of the liquid metal 3 which is exposed to pressure by the working fluid 9.

Furthermore, to prevent high-speed gas flows, so-called gas jets, when gas 9 flows in to the working pressure vessel 123 there can be a flow element (not shown) for making the gas flow constant and isotropically uniform in space. The flow element can be most simply a plate perpendicular to the entering gas flow by which the gas flow is diffusely deflected in different directions and only afterward reaches the liquid metal surface 3*c*. The following applies to the length L of the channels 3*a*: on the one hand, a minimum hole length L should be chosen such that the fluid 9' in an elastic or enclosure volume 124 does not reach the upper edge of the channel 3*a* in any operating state, especially not in the transient states, in order to prevent escape of the fluid 9' from the enclosure volume 124. On the other hand, the hole length L should be selected to be as short as possible in order to obtain reaction times of the current switch 1 as fast as possible when the liquid metal contact 3 opens and closes. Moreover, the entire pressure-exposed surface 3*c* of the liquid metal 3 should be chosen to be as large as possible in order to exert a force as large as possible on the liquid metal 3 and to further reduce the reaction time, especially the time delay between valve triggering by the control assembly 11 and opening or closing of the liquid metal contact 3.

The dielectric 5, 8, 9 can comprise a resistance means 5 with a definable electrical resistance $R_X$. The resistance element 5 should have an ohmic portion and is preferably purely ohmic. For arc-free current limitation the resistance element 5 has an electrical resistance $R_x$ which increases continuously along the direction of motion x up to an extreme second position $x_2$ for the second current path 31 and the liquid metal 3 in a transition from the first position $x_1$ to the second position $x_{12}$, $x_2$, especially to an extreme second position $x_2$, is guided along the resistance element 5. For arc-free switching of the current i(t) from the solid electrodes 2*a*, 2*b*, 2*c* to the resistance element 5 a typical minimum arc ignition voltage of 10 V–20 V which is dependent on the contact material should not be exceeded. The electrical resistance $R_x$ as a function $R_x(x_{12})$ of the second position $x_{12}$ and a path-time characteristic $x_{12}(t)$ of the liquid metal 3 along the direction of motion x should be chosen such that in each second position $x_{12}$, $x_2$ of the liquid metal 3 the product of the electrical resistance $R_x$ and current $I_2$ is less than the arc ignition voltage $U_b$ between the liquid metal 3 and the solid electrodes 2*a*, 2*b* and optionally the intermediate electrodes 2*c* and/or that sufficient steepness of current limitation for controlling grid-induced short circuit currents i(t) is achieved.

Alternatively or in addition, the dielectric 5, 8, 9 can comprise an insulator 8 which is designed for current interruption, especially as an arc forms. The dielectric can also comprise a working fluid 9. For a given voltage level, the maximum electrical resistance $R_x(x_2)$ of the dielectric 5, 8, 9 is dimensioned to a finite value according to the current $I_2$ which is to be limited or to the dielectric insulation value to interrupt the current $I_1$, $I_2$.

In the embodiments as shown in FIG. 1*a* and FIG. 1*b*, in the liquid metal tank 4 there are several channels 3*a* for the liquid metal 3 which are essentially parallel to one another, which are extended along the direction of motion x, and which are separated by wall-like segments 5*a* from one another. The segments 5*a* end in the area of the first current path 30 in a common tank area 123 for flow of the liquid metal 3 together and for transmitting the operating current $I_1$ and have individual resistances 5*a* or individual insulators 8*a* of the dielectric 5, 8 in the area of the second current path 31.

Figure 2:
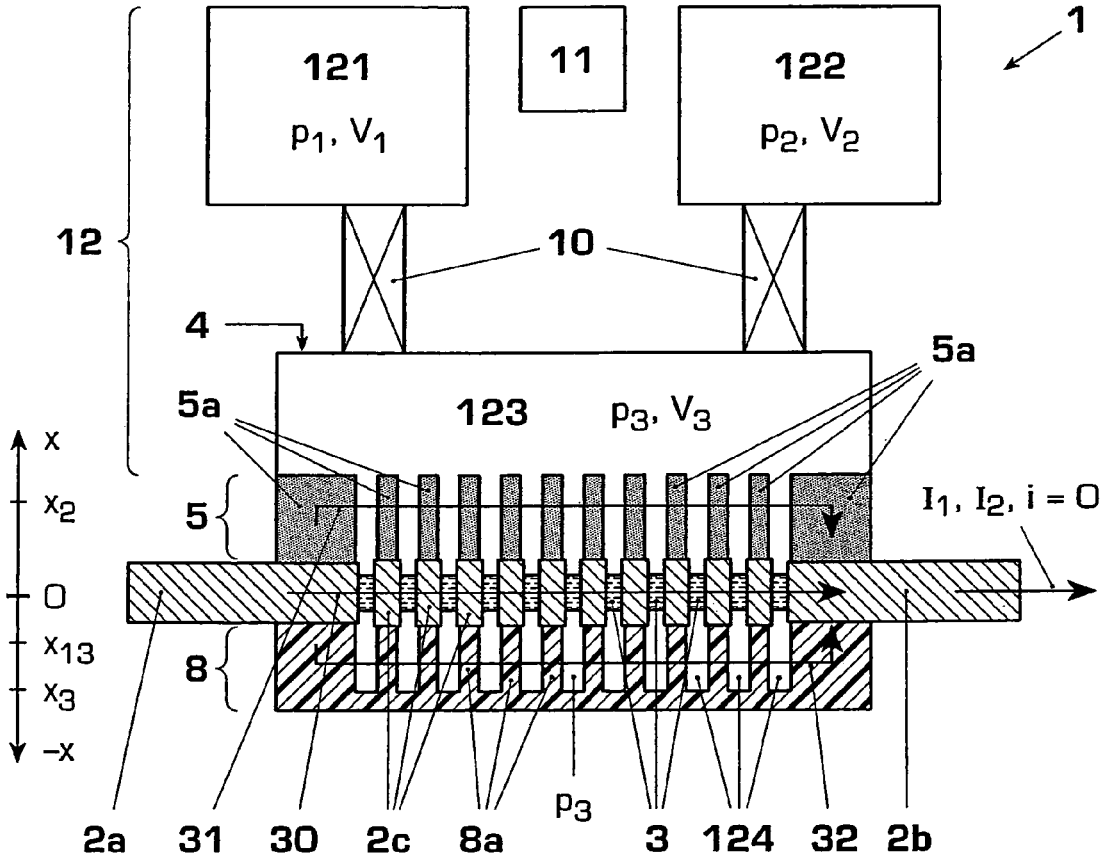
FIG. 2 shows one embodiment of a combined liquid metal current limiter and liquid metal circuit breaker with gas drive.

FIG. 2 shows a combined or integrated liquid metal current limiter 1 and a liquid metal circuit breaker 1 with a gas drive 12 for the liquid metal 3. When the liquid metal 3 is moved in the positive direction of motion +x, the current is routed on the current limitation path 31 and is limited, as discussed above. Alternatively the liquid metal 3 in a third operating state can be moved along the opposite direction of motion −x into at least one third position $x_{13}$, $x_3$, the liquid metal 3 in at least one third position $x_{13}$, $x_3$ being in series with an insulator 8 and thus an insulating clearance 32 for circuit breaking by the device 1 being formed.

For an especially compact arrangement the first or rated current path 30 and the current-limiting or second current path 31 are arranged essentially perpendicular to the direction of motion x, dictated by the lengthwise extension of the channels 3*a*, and/or are arranged essentially parallel to one another. Advantageously moreover the insulating clearance 32 for current interruption is located above the second current path 31 and/or underneath the current path 30 and parallel to it as much as possible. In this way a compact arrangement of the liquid metal 3 and its drive mechanism 12 relative to the currents $I_1$, $I_2$, I, which are to be switched, especially to the rated current path 30, current limiting path 31 and optionally the current interruption path 32 is implemented.

As shown, the segments 5*a* in turn advantageously represent individual resistances 5*a* of the resistance element 5 with an electrical resistance $R_x$ which increases along the channel depth. Thus the current-limiting second current path 31 is formed by an alternating series connection of channel areas 3*a* which are filled with liquid metal 3 and the segments 5*a* which especially preferably act as individual resistances 5*a* of the resistance element 5 which are progressive with their length. At the height of the first position $x_1$ of the liquid metal 3 the segments 5*a* should have intermediate electrodes 2*c* for electrically conductive connection of the channels 3*a* on the rated current path 30. As shown, the insulating clearance 8 can be formed by a plurality of insulating segments 8*a* which in the case of interruption are in an alternating series connection with the liquid metal columns 3 which have been moved down. In particular, there is switching between the second and third operating state by a control command, the control 11 for a current limitation command making available a low operating pressure $p_1$ for raising the liquid metal column 3 and for an interruption command a higher working pressure $p_2$ for lowering the liquid metal column 3.

In FIG. 2 the fluid drive is a gas pressure drive 12 in which a first gas pressure vessel 121 with gas in a volume $V_1$ and pressure $p_1$ and a second gas pressure vessel 122 with gas in a volume $V_2$ and pressure $p_2$ in turn communicate with the working pressure vessel 123 with a working volume $V_3$ and pressure $p_3$ by way of one controllable gas pressure valve 10 or one combined bidirectional valve (not shown) each. By choosing suitable pressures for example $p_1<p_2$, and activation of the valves 10 by the control 11, it is possible to selectively switch back and forth between the first, second and third operating state. For example, gas from 121 with a pressure $p_1$ is delivered into the working volume $V_3$ for current limitation 31 and the liquid metal columns 3 rise to $x_{12}$ or $x_2$. For rated current operation 30, intermittently gas from 122 is admitted and the liquid metal level is lowered to x=0. For power interruption 32 the tank 122 with a pressure $p_2$ is opened and the liquid metal 3 is lowered to the third position $x_{13}$ or extreme third position $x_3$. The current-limiting upper part 5 in FIG. 2 can also be designed as a current-limiting switch 1 with another insulator part 8, as described above. The enclosed gas in the enclosure volume 124 is in turn used as a restoring spring force.

Other details and versions of the gas drive 12, for example in FIG. 2, three pressure vessels with three different pressures each for one of the three operating states and especially connection of the volume 124 to a pressure vessel are possible, and is herewith expressly also encompassed. Alternatively or in addition to the gas, a different dielectric fluid, for example, oil, can be used. Suitable liquid metals 3 are for example mercury, gallium, cesium, GaInSn and the like. The liquid metal current switch 1 as claimed in the invention can satisfy the requirements for circuit breakers, especially rated current carrying capacity, short circuit current carrying capacity for a few ms, current interruption for zero current, and dielectric strength for the transient recovery voltage after current interruption and for the breakdown voltage (CIL=basic insulation level). The fluid pressure drive 12 has the special advantage that a hydraulic or generally mechanical drive for the liquid metal 3 can be avoided.

Figure 3C:
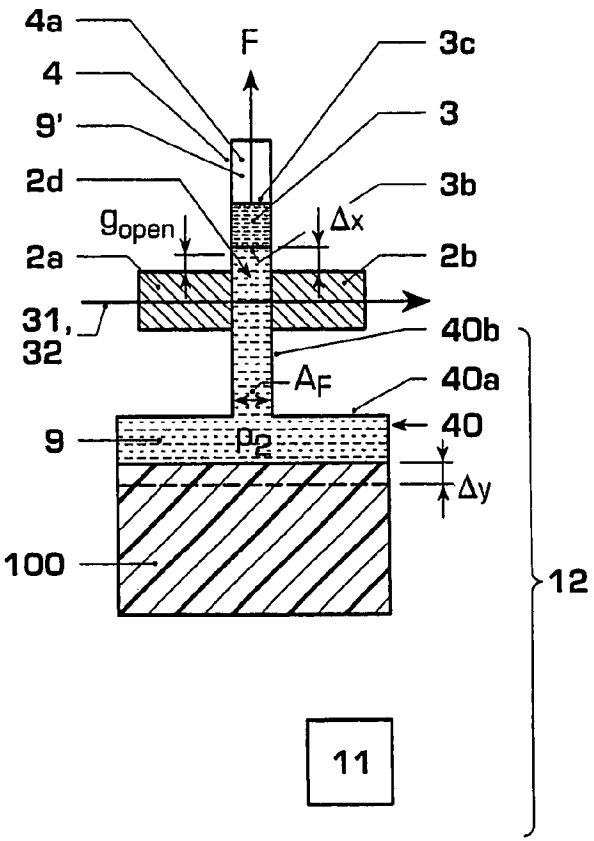
FIGS. 3*a*–3*c* show one embodiment of a liquid metal current switch with piezo-fluid drive with the liquid metal contact closed (FIG. 3*a*) or open (FIGS. 3*b*, 3*c*)
Figure 3B:
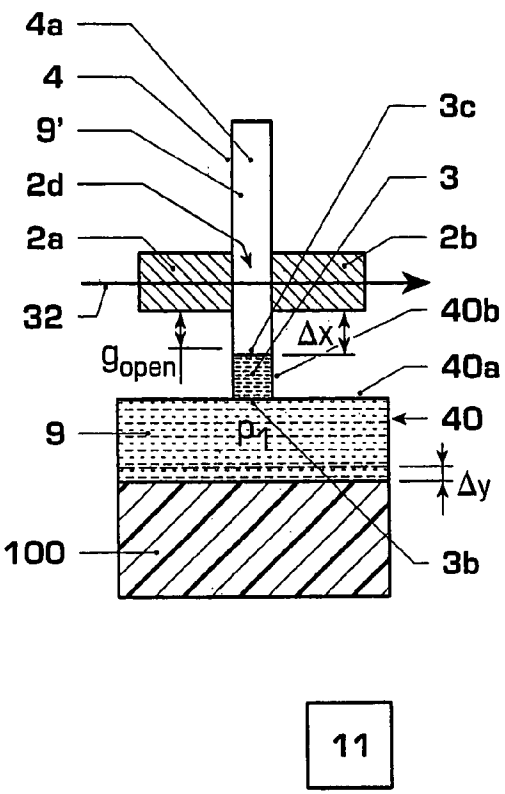
Figure 3A:
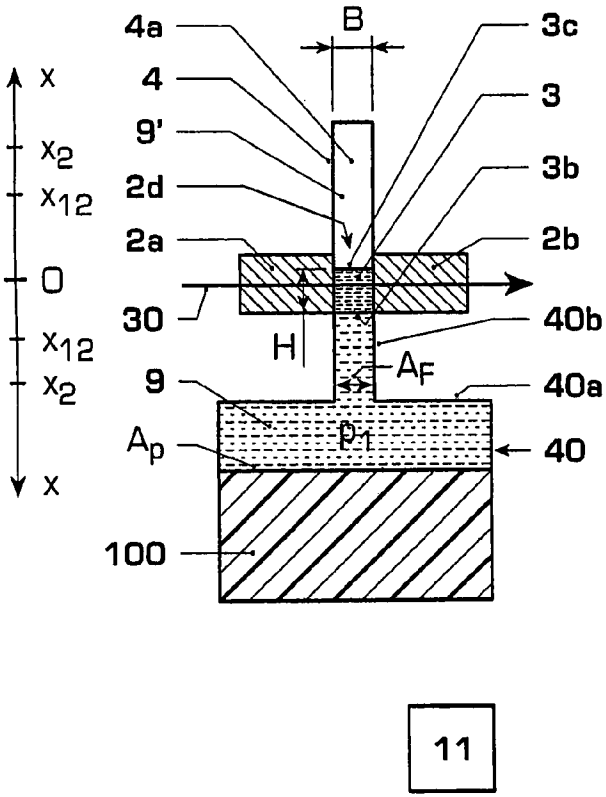

FIGS. 3*a*, 3*b*, 3*c* show in cross section one embodiment of a liquid metal current switch 1, especially of a liquid metal current limiter 1 or liquid metal circuit breaker 1, with a piezo-fluid drive 12. The current switch 1 comprises in turn solid metal electrodes 2*a*, 2*b* for connecting a current supply and a tank 4 for the liquid metal 3 in which there is at least one channel 3*a* for the liquid metal 3. The current switch 1 has a piezoelectric drive 12 for the liquid metal 3 in which by means of a working fluid 9 with a definable drive pressure $p_1$, $p_2$ mechanical action is exerted directly on the first surface 3*b* of the liquid metal 3 and the liquid metal column 3 is moved from a first position $x_1$ into a second position $x_{12}$, $x_2$. In the first position $x_1$ the liquid metal 3 is at least partially in the first current path 30 for an operating current $I_1$. In the second position $x_{12}$, $x_2$ the liquid metal 3 is at least partially and preferably completely outside of the first current path 30 so that a current limiting and/or current-interrupting second current path 31, 32 is formed by the current switch 1.

In the embodiment as shown in FIGS. 3*a*, 3*b*, 3*c* the piezodrive 12 has a piezoactuator 100 which by this movable piston 100, a dielectric drive fluid 9 for transmitting pressure from the piston 100 to the liquid metal 3, and a control 11 [sic]. The piezodrive 12 also comprises a pressure vessel 40*a* for collecting drive fluid 9 and a drive channel 40*b* for supplying drive fluid 9 to at least one channel 3*a* for the liquid metal 3. The piston 100 is for example given by the piezoactuator 100 itself. For this reason a relatively large piezocrystal is necessary. The lateral sealing of the movable piston 100 is not a problem for this purpose.

Preferably the piezodrive 12 comprises a dielectric drive fluid 9: the drive fluid 9 being incompressible, and with a pressure $p_1$, $p_2$ which can be stipulated by the piston 100 acting mechanically directly on the first surface 3*b* of the liquid metal 3; and/or a pressure $p_1$, $p_2$ which can be defined by the piston 100 in the drive fluid 9 being slightly less than the surface tension of the first surface 3*b* of the liquid metal 3 which is exposed to pressure; and/or the drive fluid 9 being located between the piston 100 and the liquid metal 3; and/or the drive fluid 9 being a dielectric liquid, especially in insulator liquid 9 such as for example transformer oil or silicone oil which is essentially not mixed with the liquid metal 3.

The liquid metal 3 can be carried over the first surface 3*c* by the drive fluid 9. As shown in FIG. 3*c*, the liquid metal 3 is moved upward for contact opening by the piezodrive 12 such that the contact gap 2*d* between the solid electrodes 2*a*, 2*b* is filled with the drive fluid 9. In this way, in the contact-opened second operating state good dielectric strength or insulation resistance of the second current path 32 is achieved.

The liquid metal 3 can also be in contact with the insulating gas 9' by way of a second surface 3*c*. As shown in FIG. 3*b*, the liquid metal 3 for contact opening by the piezodrive 12 is moved down such that the contact gap 2*d* between the fixed electrodes 2*a*, 2*b* is filled with the insulating gas 9'. The insulating gas 9' is for example dry air, nitrogen, sulfur hexafluoride, argon, or a vacuum. In this way the dielectric strength can be further improved. Moreover the following are prevented: arc ignition in the drive fluid 9, contamination of the drive fluid 9 by chemical decomposition products, chemical aging of the solid electrodes 2*a*, 2*b* by decomposition products and gas bubble formation in the drive fluid 9. In comparison, arc ignition in the insulating gas 9' is clearly less of a problem. The following applies to the pressure rating in the insulating gas 9', i.e. in the captured gas volume 4*a*: By increasing the pressure in the insulating gas 9' the dielectric strength in the contact-opened second operating state can be dimensioned to definable values; by choosing a gas volume 4*a* to be much greater than the change of the gas volume 4*a* caused by the motion of the liquid metal 3, the pressure in the insulating gas 9' can be kept largely constant so that compression work need not be performed by the piezodrive 12. A configuration is also conceivable in which the gas volume 4*a* is rated to be small relative to its change, upon contact-opening 12 of the liquid metal 3 as shown in FIG. 3*b* the piezodrive 12 is supported by the expansion work of the insulating gas 9' and thus the reaction time of contact-opening is shortened. For contact-closing then the compression work for the insulating gas 9' must be performed by the piezodrive 12; this is achieved by slightly prolonged contact closing times.

The two embodiments for opening the liquid metal contact 3 as shown in FIGS. 3*b* and 3*c* can be implemented in alternation, i.e. precluding one another, or jointly, i.e. supplementing one another, and can be controlled especially by the piezocontrol 11.

Figure 4:
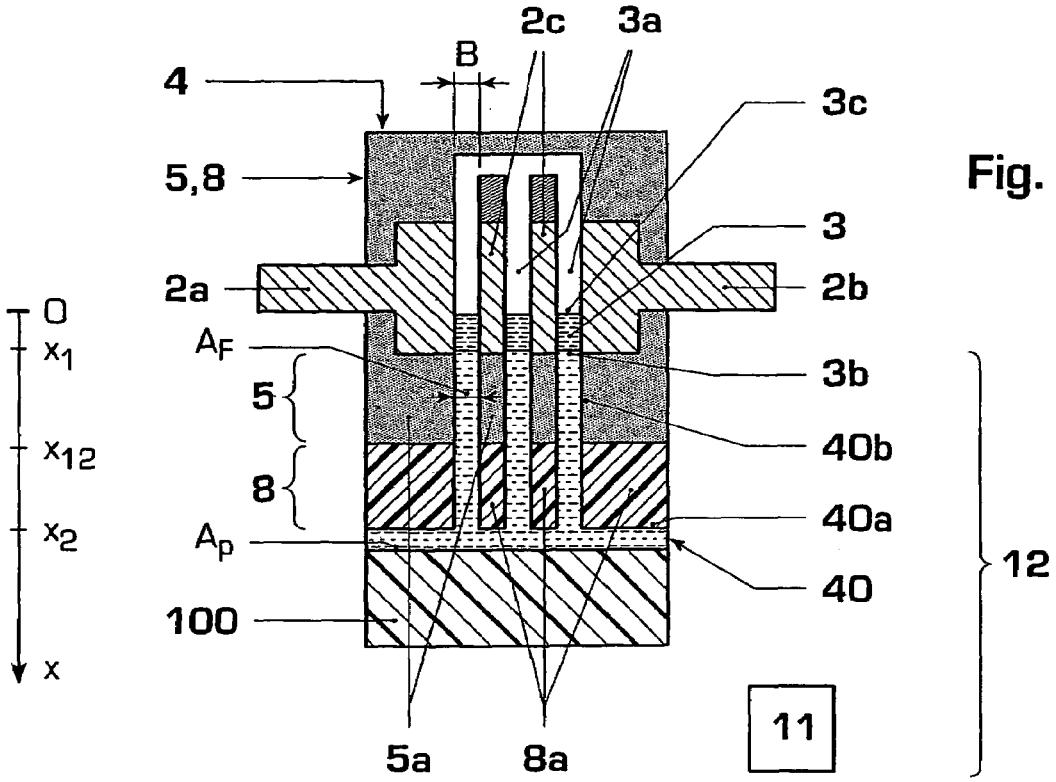
FIGS. 4, 5 show two other embodiments of the piezo-fluid drive.
Figure 5:
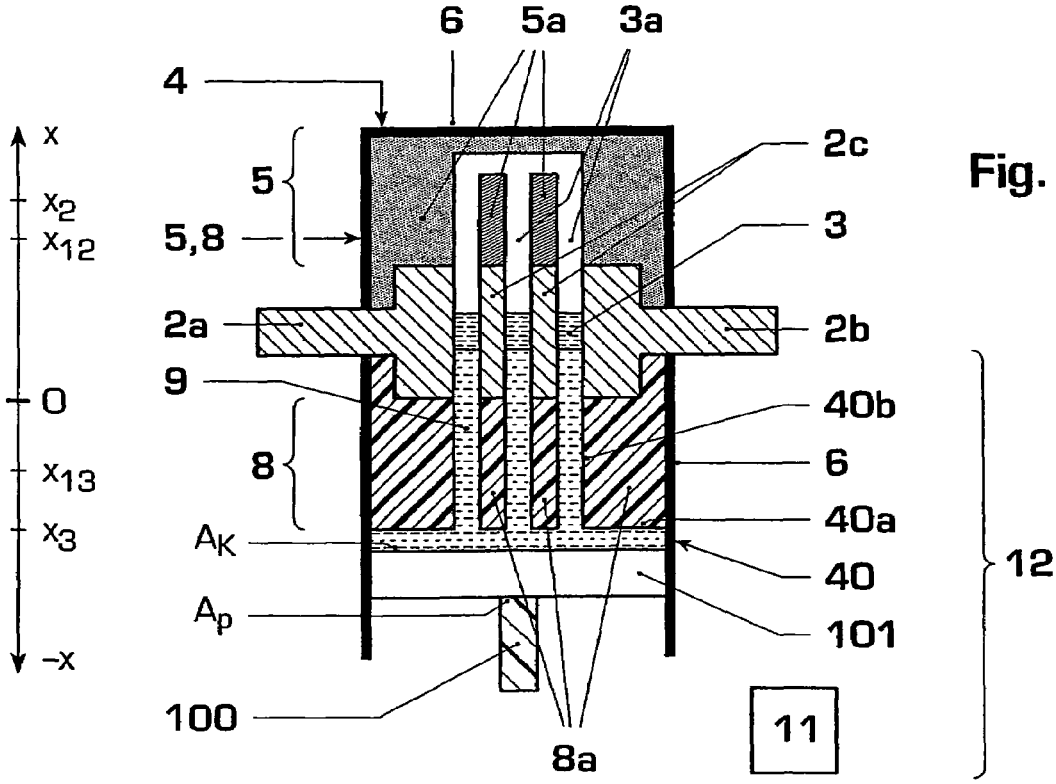

In the embodiments as shown in FIGS. 4 and 5, there are several contact gaps 2*d* between the solid electrodes 2*a*, 2*b* which are filled in the first operating state at least partially with the liquid metal 3, in the second operating state the liquid metal 3 being displaced by means of the piezodrive 12 out of the contact gaps 2*d* and being replaced by the drive fluid 9 and/or the insulating gas 9'.

In FIG. 4 the piezo-fluid drive 12 has a structure analogous to FIG. 3*a*–3*c*. In FIG. 5 the piston 101 comprises an auxiliary piston 101 which can be driven by at least one piezoactuator 100 of the piezodrive 12. In this way a much greater piston area $A_k$ for driving the liquid metal 3 can be formed and the piston area $A_k$ can be chosen independently of the size of the piezoactuator 100. Advantageously a ratio $A_F/A_K$ of the piston area $A_K$ of the piston 100, 101 to the total drive cross sectional area $A_F$ of the liquid metal 3 which is to be driven in all channels 3*a* is selected according to the ratio of one working stroke Δx for the liquid metal 3 to the piston stroke Δy of the piston 100, 101 which is to be achieved. In particular, the working stroke Δx of the liquid metal 3 should be chosen to be greater than the minimum vertical contact distance $g_{open}$ which is to be achieved. Therefore the piston area $A_k$ and the piston stroke Δy of the piston 100 are matched to the overall cross sectional area $A_F$ of the liquid metal 3 to be driven in all channels 3*a* and to the working stroke Δx which is to be achieved for the liquid metal 3.

A quantitative example is given for the design of the piezodrive 12 according to the simplest embodiment in FIG. 3*a*–FIG. 3*c*. In the contact-opened state the volume $V_F$ of the drive fluid 9 in the channels 3*a* is equal to $$V_F=A_F\cdot(H+g_{open}) \tag{G1}$$

where $A_F$=B·W=drive cross sectional area of the liquid metal column(s) to be driven, B=width of the channel 3*a* (or total width of all channels 3*a*), W=depth of the channel 3*a* (or of the channels 3*a*), H=height of the liquid metal column(s) and $g_{open}$=minimum vertical contact distance. Moreover Q=H·W=cross sectional area for a liquid metal current path 30 which is rectangular, for example. Thus $A_F$=Q·B/H.

The equation of motion for the fluid column 3, 9 which can be moved by the piezodrive 12 is then $$F\cdot A_F/A_K=[m_F+(H+g_{open}-x)\cdot Q\cdot B/H\cdot\rho_{oil}]\cdot d^2x/dt^2 \tag{G2}$$

F=piezoelectric force, $A_K$=piston area, $m_F$=mass of the liquid metal and x=position of the liquid metal column(s) 3 during dynamic switching. In equation (G2), the raising of the mass of the drive fluid 9 in the storage tank 40*a* is ignored since it is wide, deep and flat. Equation (G2) can be numerically integrated and the reaction time $t_{sep}$ of the current switch 1 can be determined as a function of the channel depth W and of the minimum vertical contact distance $g_{open}$.

Figure 6:
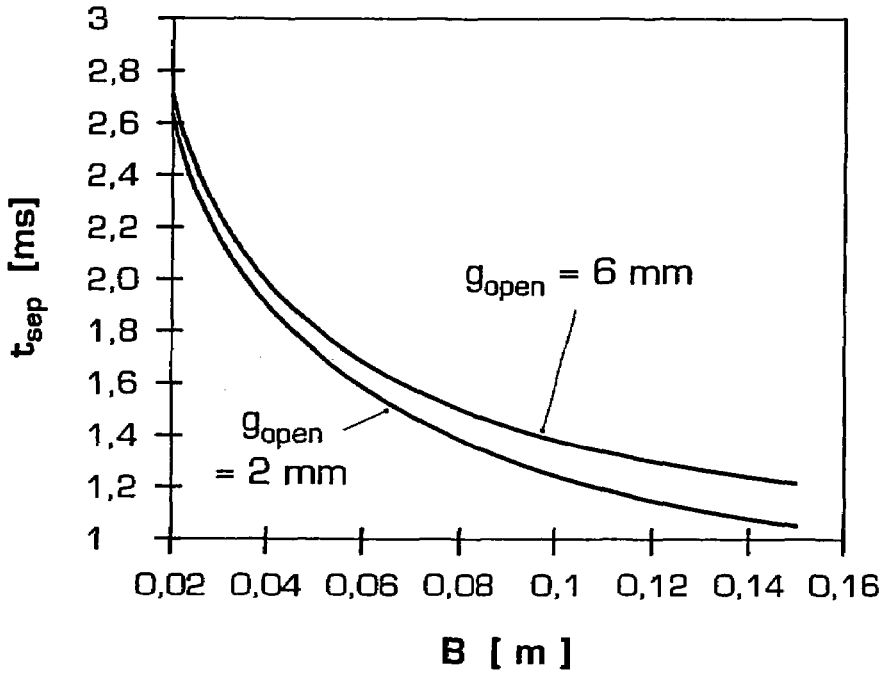
FIGS. 6 and 7 show computations of contact opening times and of the required piezoelectric stroke.

In FIG. 6 the switching time $t_{sep}$(W) is given as a function of the channel depth W for different $g_{open}$ between 2 mm and 6 mm, the following parameters being having been assumed: Q=400 $mm^2$, channel width=minimum contact gap B=8 mm (suited for a circuit breaker 1 with 12 kV rated voltage, 1250 A operating current $I_1$, 25 kA short circuit current $I_2$), F=4000 N, $A_K=A_p=(150\ mm)^2$, $[\rho]_{oil}=900\ kg/m^3$, and liquid metal density $[\rho]_F=m_F/V_F=3000\ kg/m^3$. For a fast contact opening time $t_{sep}$ the entire moving mass of the liquid metal 3 and of the drive fluid 9 $m_F+(H+g_{open})\cdot A_F\cdot\rho_{oil}$ should be kept as small as possible.

The required piezostroke Δy is equal to $$\Delta y=B\cdot W/A_K\cdot(Q/W+g_{open}) \tag{G3}$$

Figure 7:
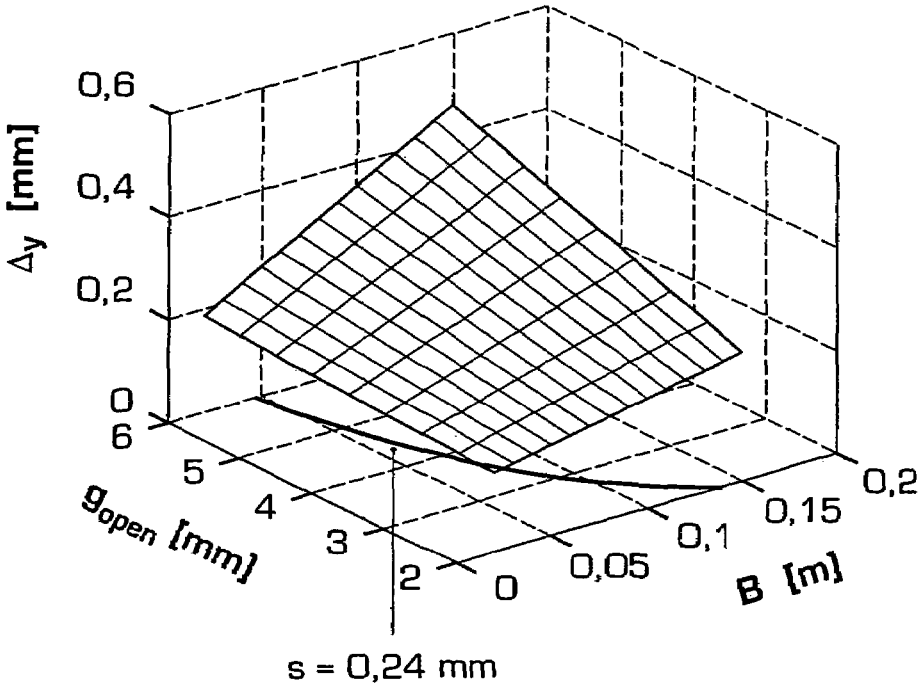

FIG. 7 shows the resulting piezostroke Δy($g_{open}$, W) as a function of the required vertical contact distance $g_{open}$ and the channel depth W. It is apparent that a current switch 1 with a maximum delay time $t_{sep}$ of 1.5 ms and a minimum vertical contact distance $g_{open}$ of 5 mm can be implemented with a piezocrystal 100 with a minimum piezoelectric working stroke of 240 μm.

The construction of the current switch 1 as shown in FIG. 4 and FIG. 5 in the liquid metal tank 4 comprises for example in turn several channels 3*a* for the liquid metal 3 which are essentially parallel to one another, extended along the direction of motion x and which are separated from one another by wall-like segments 5*a*, 8*a*. The segments 5*a*, 8*a* in the area of the first current path 30 have intermediate electrodes 2*c* for transmitting the operating current $I_2$ and in the area of the second current path 31, individual resistances 5*a* and/or individual insulators 8*a* of the dielectric 5, 8. Here an area with resistance means 5 is used to form a current-limiting second current path 31 and an area with insulating means 8 to form a second current path 32 for current interruption, especially with arc formation. The dielectric 5, 8, 9, 9' can also comprise the drive fluid 9 and/or the insulating gas 9' which likewise have a definable electrical resistance $R_x$ for the second current path 31, 32.

In general, a dielectric 5, 8, 9, 9' should be present, the liquid metal 3 in the second position $x_{12}$, $x_2$ being in series with the dielectric 5, 8, 9, 9' and with it forming a current-limiting and/or current-interrupting second current path 31, 32 in the current switch 1. The dielectric 5, 8, 9, 9' should have an ohmic portion and is preferably purely ohmic.

Advantageously the dielectric comprises a resistance means 5 which for arc-free current limitation has an electrical resistance $R_x$ which increases continuously along the direction of motion x up to an extreme second position $x_2$ for the second current path 31. For this purpose, the segments 5*a* have a dielectric material with a resistance $R_x$ which increases in the direction of motion x. The liquid metal 3 is routed in a transition from the first position x, to the second position $x_{12}$, $x_2$ along the segments 5*a* of the resistance element 5. Thus the current-limiting second current path 31 is formed by an alternating series connection of channel areas 3*a* which are filled with liquid metal 3 and the segments 5*a* which act as individual resistances 5*a* of the resistance element 5 which are progressive with their length. The criteria described in FIGS. 1–2 should be used for the electrical layout of the current switch 1 as a current limiter 1, especially for arc-free commutation of the current i(t).

FIG. 5 shows a combined or integrated liquid metal current limiter 1 and liquid metal circuit breaker 1 with a piezodrive 12 for the liquid metal 3. The tank 4 has a bottom 6 and cover 6 of insulating material between which there are a dielectric 5, 8, 9, 9' and liquid metal channels 3*a*. When the liquid metal 3 is moved in the positive direction of motion +x, the current i is routed on the current limitation path 31 and is limited, as discussed above. Alternatively the liquid metal 3 in a third operating state can be moved along the opposite direction of motion −x into at least one third position $x_{13}$, $x_3$, the liquid metal 3 in at least one third position $x_{13}$, $x_3$ being in series with an insulator 8 and thus insulating clearance 32 for circuit breaking by the device 1 being formed.

As shown, the insulating clearance 8 can be formed by a plurality of insulating segments 8*a* which in the case of interruption are in an alternating series connection with the liquid metal columns 3 which have been moved down. In particular, there is switching between the second and third operating state by a control command, the control 11 for a current limitation command producing a piezomotion or piezoelectric force F up for raising the liquid metal column 3 and for an interruption command a piezoelectric force down to lower the liquid metal column 3.

For one especially compact arrangement, as in FIG. 2, the first or rated current path 30 and the current-limiting or second current path 31 are arranged essentially perpendicular to the direction of motion x, dictated by the lengthwise extension of the channels 3*a*, and/or are arranged essentially parallel to one another. Moreover the insulating clearance 32 for current interruption is advantageously located above the second current path 31 and/or underneath the first current path 30 and parallel to them as much as possible.

Preferably the liquid metal 3 is set into ordered flowing motion by the piezo-fluid drive 12. Thus the liquid metal 3 in the first and the second operating state remains in the liquid aggregate state. In this way high currents can be limited or interrupted with very fast reaction times of down to less than 1 ms even without the pinch effect. The piezo-liquid metal current switch 1 can also satisfy the requirements for circuit breakers mentioned in FIGS. 1–2 and a hydraulic or complex mechanical drive for the liquid metal 3 can be avoided. In principle the piezodrive 12 can also work without a working fluid 9 and can act directly on the liquid metal 3.

Applications of the device 1 relate among others to use as a current limiter, current-limiting switch and/or circuit breaker 1 in power supply grids, as a self-recovering fuse or as an engine starter. The invention also comprises an electrical switchgear assembly, especially a high or medium voltage switchgear assembly, characterized by a device 1 as described above.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. Process for current limiting and/or circuit breaking with a liquid metal current switch which comprises solid electrodes and a liquid metal tank with at least one channel for a liquid metal, in the first operating state between the solid electrodes an operating current ($I_1$) being routed on a first current path through the current switch and the first current path being routed at least partially through the liquid metal which is in the first position ($x_1$), wherein in a second operating state a) the liquid metal is moved by a dielectric fluid drive which is controlled by a control along one direction of motion (x) into at least one second position ($x_{12}$, $x_2$), dielectric working fluid being used which acts mechanically directly with a definable drive pressure ($p_1$, $p_2$) on one surface of the liquid metal, and b) the liquid metal in at least one second position ($x_{12}$, $x_2$) is located at least partially in series with the dielectric and in this way a current-limiting and/or current-interrupting second current path is formed by the current switch, c) for a given voltage level a maximum electrical resistance ($R_x(x_2)$) of the dielectric being dimensioned to a finite value according to the current ($I_2$) which is to be limited or to a dielectric insulation value for interrupting the current ($I_1$, $I_2$).

2. Process as claimed in claim 1, wherein a) the working fluid is a dielectric gas and/or a dielectric liquid and the working fluid is essentially not mixed with the liquid metal and b) especially wherein the working fluid is an insulating gas, especially dry air, nitrogen, sulfur hexafluoride, argon or a vacuum, and/or an insulator liquid, especially transformer oil or silicone oil.

3. Process as claimed in claim 1, wherein a) the drive pressure ($p_1$, $p_2$) is chosen to be slightly lower than the surface tension of the surface of the liquid metal which is exposed to pressure and/or b) the liquid metal in the first and in the second operating state remains in the liquid aggregate state.

4. Process as claimed in claim 1, wherein a) the dielectric is a resistance element with a definable electrical resistance ($R_X$), b) the liquid metal in a transition from the first position ($x_1$) to the second position ($x_{12}$, $x_2$), especially to an extreme second position ($x_2$), is guided along the resistance element and c) the resistance element has an electrical resistance ($R_x$) which increases along the direction of motion (x) of the liquid metal for the second current path.

5. Process as claimed in claim 1, wherein in a third operating state a) the liquid metal is moved along the opposite direction of motion (−x) into at least one third position ($x_{13}$, $x_3$) and b) the liquid metal in at least one third position ($x_{13}$, $x_3$) is in series with an insulator and thus an insulating clearance for circuit breaking by the device is formed and c) especially wherein the third operating state is triggered by an interruption command by which the fluid drive is switched over between operation of the current switch as the current limiter and as a circuit breaker.

6. Process as claimed in claim 1, wherein the dielectric fluid drive is a pressure drive with pressure vessels, valves and a control for a working fluid by which a working pressure vessel for the working fluid for moving the liquid metal can be connected to an interruption pressure vessel for contact opening of the liquid metal and to a connection pressure vessel for contact-closing of the liquid metal.

7. Process as claimed in claim 1, wherein the dielectric fluid drive is a piezodrive with at least one piezoelectrically driven piston and the drive fluid is incompressible and with a pressure ($p_1$, $p_2$) which can be dictated by the piston acts mechanically directly on the first surface of the liquid metal.

8. Process as claimed in claim 7, wherein a) the liquid metal is carried over the first surface by the drive fluid and the liquid metal is moved for contact opening by the piezodrive such that a contact gap between the solid electrodes is filled with the drive fluid and/or b) the area ($A_k$) of the piston is greater than or equal to the piezoelectrically driven area ($A_p$) of a piezoactuator of the piezodrive.

9. Liquid metal current switch for current limiting and/or circuit breaking, especially for executing the process as claimed in one of the preceding claims, comprising solid electrodes and a liquid metal tank with at least one channel for a liquid metal, in the first operating state between the solid electrodes there being a first current path for an operating current ($I_1$) through the current switch and the first current path leading at least partially through the liquid metal which is in the first position ($x_1$), wherein a) a dielectric fluid drive has a working fluid and a control and is designed for moving the liquid metal along one direction of motion (x) into at least one second position ($x_{12}$, $x_2$), the working fluid being dielectric and acting mechanically directly with a definable drive pressure ($p_1$, $p_2$) on one surface of the liquid metal, and b) in the liquid metal tank there is a dielectric and c) in the second operating state the liquid metal in at least one second position ($x_{12}$, $x_2$) is at least partially in series with the dielectric and thus forms a current-limiting and/or current-interrupting second current path in the current switch, d) for a given voltage level a maximum electrical resistance ($R_x(x_2)$) of the dielectric being dimensioned to a finite value according to the current ($I_2$) which is to be limited or to a dielectric insulation value for interrupting the current ($I_1$, $I_2$).

10. Liquid metal current switch as claimed in claim 9, wherein a) the drive pressure ($p_1$, $p_2$) is rated according to the switching time of the current switch (1), especially according to the overcurrent ($I_2$) which is to be limited, and a path-time characteristic (x(t)) of the liquid metal in the second current path which is necessary for this purpose, and/or b) the drive pressure ($p_1$, $p_2$) is chosen to be lower than the surface tension of the surface of the liquid metal which is exposed to pressure.

11. Liquid metal current switch as claimed in claim 9, wherein a) a cross sectional area (Q) of the liquid metal in the first current path is dimensioned according to the current carrying capacity of the current switch and/or b) the width (S) and number of segments for separating the channels for the liquid metal and a type of working fluid are dimensioned according to the dielectric strength of the current switch in a second operating state; and/or c) the cross section (Q') and the surface composition of the channels for the liquid metal and the type of liquid metal are dimensioned according to the required surface tension of the surface of the liquid metal which is exposed to pressure.

12. Liquid metal current switch as claimed in claim 9, wherein a) the dielectric comprises a resistance means which for arc-free current limitation has an electrical resistance ($R_x$) which increases continuously along the direction of motion (x) up to an extreme second position ($x_2$) for the second current path and/or b) the dielectric comprises an insulator which is designed for current interruption, especially with arc formation.

13. Liquid metal current switch as claimed in claim 9, wherein a) in the liquid metal tank there are several channels for the liquid metal which are essentially parallel to one another, which extended along the direction of motion (x) and which are separated by wall-like segments from one another and b) the segments end in the area of the first current path in a common tank area for flow of the liquid metal together and for transmitting the operating current ($I_1$) and the segments in the area of the second current path have individual resistances or individual insulators of the dielectric.

14. Liquid metal current switch as claimed in claim 9, wherein a) the first path for the operating current ($I_1$), the second current path for current limitation and especially an insulating clearance for current interruption are arranged essentially perpendicular to the direction of motion (x) and/or are arranged essentially parallel to one another, and/or b) at least the insulating clearance for current interruption is located above the second current path and/or underneath the first current path.

15. Liquid metal current switch as claimed in claim 9, wherein a) the fluid drive has first means for producing a drive pressure ($p_1$, $p_2$) in the fluid and second means for bringing the working fluid into contact with the liquid metal, b) especially wherein the first means comprise an interruption pressure vessel for contact opening of the liquid metal and a connection pressure vessel for contact closing of the liquid metal, and c) especially wherein the second means comprise at least one valve and a working pressure vessel for transferring the pressure from the working fluid to the liquid metal and preferably a compression pressure vessel with a captured compressible fluid for applying a resetting force to the back surface of the liquid metal.

16. Liquid metal current switch as claimed in claim 9, wherein the fluid drive has a piezodrive with at least one piezoelectric piston for moving the liquid metal.

17. Liquid metal current switch as claimed in claim 16, wherein a) the piezodrive has a piezoactuator which by this movable piston and a dielectric drive fluid for transmitting pressure from the piston to the liquid metal and/or b) the piezodrive comprises a pressure vessel for collecting the drive fluid and a drive channel for supplying the drive fluid to at least one channel for the liquid metal.

18. Liquid metal current switch as claimed in claim 16, wherein a) the drive fluid of the piezodrive is an insulator liquid which is incompressible and which cannot be mixed with the liquid metal and which is in direct pressure exchange with at least one pressure-exposed first surface of the liquid metal and/or b) in the second operating state the liquid metal is displaced by the piezodrive out of the contact gaps and is replaced by the drive fluid and/or the insulating gas.

19. Electrical switchgear assembly, especially a high or medium voltage switchgear assembly, comprising a liquid metal current switch for current limiting and/or circuit breaking, especially for executing the process as claimed in one of the preceding claims, comprising solid electrodes and a liquid metal tank with at least one channel for a liquid metal, in the first operating state between the solid electrodes there being a first current path for an operating current ($I_1$) through the current switch and the first current path leading at least partially through the liquid metal which is in the first position ($x_1$), wherein a) a dielectric fluid drive has a working fluid and a control and is designed for moving the liquid metal along one direction of motion (x) into at least one second position ($x_{12}$, $x_2$), the working fluid being dielectric and acting mechanically directly with a definable drive pressure ($p_1$, $p_2$) on one surface of the liquid metal, and b) in the liquid metal tank there is a dielectric and c) in the second operating state the liquid metal in at least one second position ($x_{12}$, $x_2$) is at least partially in series with the dielectric and thus forms a current-limiting and/or current-interrupting second current path in the current switch, d) for a given voltage level a maximum electrical resistance ($R_x(x_2)$) of the dielectric being dimensioned to a finite value according to the current ($I_2$) which is to be limited or to a dielectric insulation value for interrupting the current ($I_1$, $I_2$).

* * * * *